US005914223A

United States Patent [19]

Wang et al.

[11] Patent Number: 5,914,223

[45] Date of Patent: Jun. 22, 1999

[54] PHOTOGRAPHIC ELEMENT WITH OUTER LAYER HAVING IMPROVED PHYSICAL PERFORMANCE

[75] Inventors: Yongcai Wang, Penfield; Alfred B. Fant, Rochester; Gary W. Visconte, Rochester; Kurt M. Schroeder, Rochester, all of N.Y.

[73] Assignee: Eastman Kodak Company, Rochester, N.Y.

[21] Appl. No.: 08/815,257

[22] Filed: Mar. 12, 1997

[51] Int. Cl.[6] ..... G03C 1/815

[52] U.S. Cl. ..... 430/512; 430/510; 430/527; 430/536; 430/537; 430/931; 430/961

[58] Field of Search ..... 430/512, 961, 430/931, 546, 536, 537, 527, 510

[56] References Cited

U.S. PATENT DOCUMENTS

| | | | |
|---|---|---|---|
| 2,739,888 | 3/1956 | Sawdey | 430/512 |
| 3,215,530 | 11/1965 | Riebel et al. | 430/512 |
| 3,352,681 | 11/1967 | Ohi et al. | 430/512 |
| 3,707,375 | 12/1972 | Ohi et al. | 430/517 |
| 4,199,363 | 4/1980 | Chen | 430/512 |
| 4,247,627 | 1/1981 | Chen | 430/512 |
| 4,304,769 | 12/1981 | Chen | 424/218 |
| 4,368,258 | 1/1983 | Fujiwhara et al. | 430/512 |
| 5,500,332 | 3/1996 | Vishwakarma et al. | 430/512 |
| 5,536,628 | 7/1996 | Wang et al. | 430/531 |
| 5,585,228 | 12/1996 | Vishwakarma et al. | 430/512 |
| 5,594,047 | 1/1997 | Nielsen et al. | 430/517 |
| 5,683,861 | 11/1997 | Vishwakarma et al. | 430/512 |

*Primary Examiner*—Richard L. Schilling
*Attorney, Agent, or Firm*—Carl F. Ruoff

[57] ABSTRACT

The present invention is a silver halide photographic element which includes a support, at least one light sensitive silver halide emulsion layer; and at least one light-insensitive protective layer. The light insenstive protective layer includes a hydrophilic binder, a colloidal silver particle and an ultraviolet ray absorbing polymer particle having a mean size of greater than 0.01 $\mu$m. The ultraviolet ray absorbing polymer particle contains an ultraviolet ray absorber and a polymer derived from monomer A and less than 10 weight percent of monomer B, wherein monomer A represents ethylenically unsaturated monomers which form substantially water insoluble homopolymers, and monomer B represents ethylenically unsaturated monomers capable of forming water soluble homopolymers.

13 Claims, No Drawings

PHOTOGRAPHIC ELEMENT WITH OUTER LAYER HAVING IMPROVED PHYSICAL PERFORMANCE

FIELD OF THE INVENTION

This invention relates to an image element, and in particular to a silver halide photographic element comprising at least one light insensitive layer comprising a colloidal silver particle and an ultraviolet ray absorbing polymer particle.

BACKGROUND OF THE INVENTION

It is conventional to incorporate an absorbing compound or absorber, in particular, an ultraviolet ray absorbing compound, in an image element to absorb light in a specific wavelength region. The ultraviolet absorbing light-insensitive layer is used, for example, in a silver halide photographic element, to control the spectral composition of light incident upon a photographic emulsion layer, and to absorb or to remove ultraviolet light produced by static discharge, which occurs when the surfaces of the photographic element come into contact during production or treatment processes. Electric charges are generated by friction of separation. When accumulation of static electricity by charging reaches a certain limiting value, atmospheric discharge occurs at a particular moment and a discharge spark fires at the same time. When the photographic element is exposed to light by discharging, static marks appear after development.

Different methods for incorporating an ultraviolet ray absorber into a photographic element have been described in, for example, U.S. Pat. Nos. 2,739,888, 3,215,530, 3,352,681, and 3,707,375, where an oil soluble absorber is dissolved in a high boiling organic solvent (HBS), and mixed under high shear or turbulence together with an aqueous medium, which may also contain a surfactant, in order to break the organic phase into submicron particles dispersed in the continuous aqueous phase.

Prior art also teaches to incorporate colloidal silver particles in a silver halide photographic element to stop unwanted chemicals from entering the light sensitive emulsion layers during photographic processing. The unwanted chemicals can react with couplers and sensitizing dyes to change photographic properties.

In color light-sensitive photographic elements, it is preferable to incorporate both ultraviolet ray absorber/HBS dispersions and colloidal silver particles in layers above the silver halide emulsion layers for maximum protection. Therefore, it is not uncommon that both ultraviolet ray absorber/HBS dispersions and colloidal silver particles are incorporated in the same light-insensitive hydrophilic layer. A negative aspect of such a layer structure is the appearance of oily-bubble like spot defects in that layer and in adjacent layers. Such oily-bubble like spot defects are formed largely due to coating solution instability. It is likely that the presence of colloidal silver particles in the coating solution destabilizes ultraviolet ray absorber/HBS dispersions, and therefore induces the formation of oily-like particulates in the micron-size range. During the coating process, such large oily-like particulates can diffuse into, for example, the adjacent emulsion layers appearing as spot defects, and the adjacent outermost surface protective layer causing surface tackiness and degrading the layer scratch and abrasion resistance.

A foremost objective of the present invention is to provide a silver halide photographic element comprising ultraviolet ray absorbers and colloidal silver particles having good coating solution stability. Another objective of the present invention is to provide an outermost protective layer that has excellent resistance to oily-bubble spot defect formation, and excellent physical scratch and abrasion properties.

SUMMARY OF THE INVENTION

The present invention is a silver halide photographic element which includes a support, at least one light sensitive silver halide emulsion layer; and at least one light-insensitive protective layer. The light insenstive protective layer includes a hydrophilic binder, a colloidal silver particle and an ultraviolet ray absorbing polymer particle having a mean size of greater than 0.01 $\mu$m. The ultraviolet ray absorbing polymer particle contains an ultraviolet ray absorber and a polymer derived from monomer A and less than 10 weight percent of monomer B, wherein monomer A represents ethylenically unsaturated monomers which form substantially water insoluble homopolymers, and monomer B represents ethylenically unsaturated monomers capable of forming water soluble homopolymers.

DETAILED DESCRIPTION OF THE INVENTION

Photographic elements according to this invention can differ widely in structure and composition. For example, they can vary in regard to the type of the support, the number and composition of the imaging forming layers, and the kinds of auxiliary layers that are included in the elements. The invention is particularly applicable to photographic elements comprising polymeric film supports. Typical polymeric film supports include cellulose nitrate film, cellulose acetate film, poly(vinyl acetal) film, polystyrene film, polyester film such as poly(ethylene terephthalate) film and poly(ethylene naphthalate) film, polycarbonate film, and the like. The support may be annealed or not.

The photographic element of the present invention comprises at least one light sensitive layer, and at least one light insensitive layer comprising a hydrophilic colloid, a colloidal silver particle, and an ultraviolet ray absorbing polymer particle. The weight ratio of ultraviolet ray absorbing particle to hydrophilic binder in the light-insensitive layer ranges from 5:95 to 80:20, preferably from 10:90 to 60:40, and most preferably from 10:90 to 50:50. The colloidal silver particle has a coating weight in the range of from 10 to 500 mg/m$^2$, preferably from 100 to 400 mg/m$^2$, and most preferably from 150 to 300 mg/m$^2$. The thickness of the light-insensitive layer ranges from 0.1 to 6 $\mu$m, and preferably from 0.3 to 4 $\mu$m, and most preferably from 0.5 to 3 $\mu$m. The term of "thickness" used here refers to the thickness measured, for example, by an electron micrograph of a non-swollen cross-section.

The ultraviolet ray absorbing polymer particles of the present invention comprise a polymer and an ultraviolet ray absorber, and have a mean size of greater than 0.01 $\mu$m, preferably from 0.01 to 10 $\mu$m, and most preferably from 0.02 to 0.5 $\mu$m. The polymers contained in the ultraviolet ray absorbing particle comprising units derived from monomer A and less than 10 weight % of monomer B, where A presents ethylenically unsaturated monomers which form substantially water insoluble homopolymers, and B represents ethylenically unsatuarted monomers capable of forming water soluble homopolymers. In general, the weight ratio of ultraviolet absorber to polymer in the ultraviolet ray absorbing particle can be anywhere within the range of 1:40 to 3:1, preferably from about 1:10 to 2:1, and most preferably from about 1:5 to 1:1.

Any suitable ethylenically unsaturated monomers may be used for the preparation of the polymers contained in the ultraviolet ray absorbing polymer particles of the present invention as long as the stated glass transition temperature requirement and monomer ratios and percentages are maintained. In accordance with the invention, A represents "hydrophobic monomers" which would form a substantially water insoluble homopolymer, and B represents "hydrophilic monomers" which are capable of forming substantially water soluble homopolymers.

Suitable ethylenically unsaturated monomers which can be used as component A of the present invention include, for example, the following monomers and their mixtures: alkyl esters of acrylic or methacrylic acid such as methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, the hydroxyalkyl esters of the same acids such as 2-hydroxyethyl acrylate, 2-hydroxyethyl methacrylate, and 2-hydroxypropyl methacrylate, and the nitrile and amides of the same acids such as acrylonitrile, methacrylonitrile, and butyl acrylamide, vinyl acetate, vinyl propionate, vinylidene chloride, vinyl chloride, and vinyl aromatic compounds such as styrene, t-butyl styrene, ethyl vinyl benzene, vinyl toluene, dialkyl maleates, dialkyl itaconates, dialkyl malonates, isoprene, and butadiene. Crosslinking and grafting monomers which may be used together with the foregoing monomers to crosslink the ultraviolet ray absorbing polymer particles are polyfunctional with respect to the polymerization reaction, and may include, for example, esters of unsaturated monohydric alcohols with unsaturated monocarboxylic acids, such as allyl methacrylate, allyl acrylate, butenyl acrylate, undecenyl acrylate, undecenyl methacrylate, vinyl acrylate, and vinyl methacrylate, esters of saturated glycols or diols with unsaturated monocarboxylic acids, such as ethylene glycol diacrylate, ethylene glycol dimethacrylate, triethylene glycol dimethacrylate, 1,4-butanediol dimethacrylate, 1,3-butanediol dimethacrylate, and polyfunctuional aromatic compounds such as divinyl benzene.

Suitable ethylenically unsaturated nonionic hydrophilic monomers which can be used as component B of the present invention include, for example, (meth)acrylamides such as acrylamide, methacrylamde, N,N-dimethyl acrylamide, N-methylol acrylamide, and isopropyl acrylamide. Additional suitable hydrophilic monomers include poly(ethylene glycol)(meth)acrylates, N-vinyl-2-pyrrolidone, vinylimidazole, and the like.

Ethylenically unsaturated ionic monomers which can be used as component B of the present invention include, for example, monomers containing carboxylic acid, sulfo, or oxysulfo pendent groups, or salts of such groups. Representative monomers include acrylic acid, methacrylic acid, and sodium acrylamido-2-methylpropane sulfonate.

The types of ultraviolet ray absorbers which can be used for the practice of the present invention are not particularly limited provided their absorption maximum wavelengths fall within the range of 300 to 400 nm, and they have no harmful effect on the imaging properties of the element. Such UV absorbers include ultraviolet absorbers of the thiazolidone type, the benzotriazole type, the cinnamic acid ester type, the benzophenone type, and the aminobutadiene type and have been described in detail in, for example, U.S. Pat. Nos. 1,023,859, 2,685,512, 2,739,888, 2,748,021, 3,004,896, 3,052,636, 3,215,530, 3,253,921, 3,533,794, 3,692,525, 3,705,805, 3,707,375, 3,738,837, 3,754,919, and British Patent No. 1,321,355.

A preferred ultraviolet ray absorber useful for the practice of the present invention is represented by formula I.

(I)

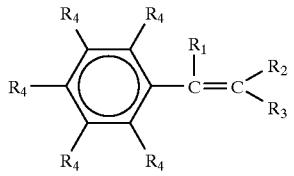

wherein $R_4$ may be the same or different, and each represents a hydrogen atom, a halogen atom, an alkyl, an aryl group having from 6 to 20 carbon atoms, an alkoxy group, an aryloxy, an alkylthio group, an arylthio group, an amine group, an alkylamino group, an arylamino group, an hydroxyl group, a cyano group, a nitro group, an acylamino group, a sulfonyl group, a sulfoamido group, an acyloxy group, or an oxycarbonyl group, or two neighboring R groups may form a 5- or 6-member ring by ring closure. $R_1$ represents a hydrogen atom, or an alkyl group. $R_2$ or $R_3$ each represents a cyano group, —$COOR_9$, —CO—$NHR_9$, —$SO_2R_9$, CO—$R_9$, where $R_9$ represents an alkyl group, and an aryl group.

Most preferred ultraviolet ray absorbers represented by formula I are given by formula II.

(II)

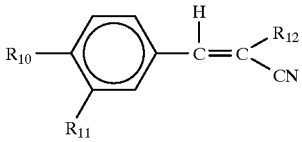

The following represents limited examples of compounds given by formula II.

| Compound No. | $R_{10}$ | $R_{11}$ | $R_{12}$ |
|---|---|---|---|
| UV-44 | H | H | $CO_2C_{16}H_{33}$ |
| UV-45 | $CH_3$ | H | $CO_2C_{16}H_{33}$ |
| UV-3 | $CH_3$ | H | $CO_2C_3H_7$ |
| UV-4 | $CH_3$ | H | $CO_2C_{12}H_{25}$ |
| UV-5 | $CH_3$ | H | $SO_2C_{12}H_{25}$ |
| UV-6 | $OCH_3$ | H | $CO_2C_3H_7$ |
| UV-7 | $OCH_3$ | H | $CO_2C_5H_{11}$ |
| UV-8 | $OCH_3$ | H | 2-ethylhexyl |
| UV-9 | $OCH_3$ | H | $CO_2C_8H_{17}$ |
| UV-10 | $OCH_3$ | H | $CO_2C_9H_{19}$ |
| UV-11 | $OCH_3$ | H | $CO_2C_{10}H_{21}$ |
| UV-12 | $OCH_3$ | H | $CO_2C_{12}H_{25}$ |
| UV-13 | $OCH_3$ | H | $CO_2C_{16}H_{33}$ |
| UV-14 | $OCH_3$ | H | $CO_2C_{18}H_{37}$ |
| UV-15 | $OCH_3$ | H | $SO_2C_{12}H_{25}$ |
| UV-16 | $OCH_3$ | H | $SO_2C_{10}H_{21}$ |
| UV-17 | $OCH_3$ | H | $SO_2C_8H_{17}$ |
| UV-18 | $OCH_3$ | H | $SO_2C_6H_{13}$ |
| UV-19 | $OCH_3$ | H | $SO_2C_4H_9$ |
| UV-20 | $OCH_3$ | H | $SO_2C_3H_7$ |
| UV-21 | $OCH_3$ | H | $SO_2CH_3$ |
| UV-22 | $OC_3H_7$ | H | $CO_2C_3H_7$ |
| UV-22 | $OC_3H_7$ | H | $CO_2C_5H_{11}$ |
| UV-23 | $OC_3H_7$ | H | 2-ethylhexyl |
| UV-24 | $OC_3H_7$ | H | $CO_2C_8H_{17}$ |
| UV-25 | $OC_3H_7$ | H | $CO_2C_9H_{19}$ |
| UV-26 | $OC_3H_7$ | H | $CO_2C_{10}H_{21}$ |
| UV-27 | $OC_3H_7$ | H | $CO_2C_{12}H_{25}$ |
| UV-28 | $OC_3H_7$ | H | $CO_2C_{16}H_{33}$ |
| UV-29 | $OC_3H_7$ | H | $CO_2C_{18}H_{37}$ |

-continued

| Compound No. | $R_{10}$ | $R_{11}$ | $R_{12}$ |
|---|---|---|---|
| UV-30 | $OC_3H_7$ | H | $SO_2C_{12}H_{25}$ |
| UV-31 | $OC_3H_7$ | H | $SO_2C_{10}H_{21}$ |
| UV-32 | $OC_3H_7$ | H | $SO_2C_8H_{17}$ |
| UV-33 | $OC_3H_7$ | H | $SO_2C_6H_{13}$ |
| UV-34 | $OC_3H_7$ | H | $SO_2C_4H_9$ |
| UV-35 | $OC_3H_7$ | H | $SO_2C_3H_7$ |
| UV-36 | $OC_3H_7$ | H | $SO_2CH_3$ |
| UV-37 | $OC_2H_5$ | $OCH_3$ | $CO_2C_2H_5$ |
| UV-38 | $OC_4H_9$ | $OCH_3$ | $CO_2C_2H_5$ |
| UV-39 | $OC_6H_5$ | $OCH_3$ | $CO_2C_2H_4OH$ |
| UV-40 | $OCH_2C_6H_5$ | OH | $CO_2C_2H_5$ |
| UV-41 | $OC_6H_5$ | $OCH_3$ | $CO_2C_2H_5$ |
| UV-42 | $OCH_2OCO_2C_2H_5$ | $OCH_3$ | $CONHC_6H_5$ |
| UV-43 | $OC_2H_4OCOCH_3$ | $OCH_3$ | $CONHCH_2C_6H_5$ |

A second preferred ultraviolet ray absorber for the practice of the present invention has structures given by formula III:

(III)

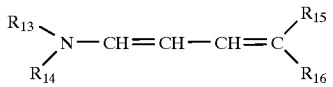

where $R_{13}$, and $R_{14}$, which may be the same or different, each represents a hydrogen atom, an alkyl group, an aryl group, $R_{15}$ and $R_{16}$ each represents a cyano group, —$COOR_{17}$, $COR_{17}$, $SO_2R_{17}$, where $R_{17}$ represents an alkyl group, or an aryl group.

A third preferred ultraviolet ray absorber for the practice of the present invention is represented by formula IV:

(IV)

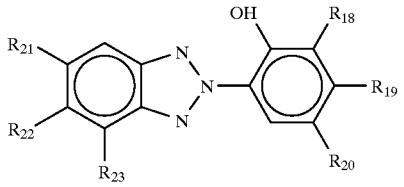

where $R_{18}$, $R_{19}$, $R_{20}$, $R_{21}$, $R_{22}$, and $R_{23}$ may be the same or different, and each represents a hydrogen atom, a halogen atom, a nitro group, a hydroxyl group, an alkyl group, an aryl group, an alkoxy group, an aryloxy group, an alkylthio group, an arylthio group, an aralkylthio group, an akoxycarbonyl group, a carbamoyl group, an alkylsulfonyl group, a mono or dialkylamino group, etc.

The ultraviolet ray absorbing polymer particles of this invention can be made by various well-known techniques in the art, such as, for example, emulsion polymerization, dispersion polymerization, suspension polymerization, and the like (see, for example, Padget, J. C. *Journal of Coating Technology*, Vol 66, No. 839, pages 89–105, 1994; El-Aasser, M. S. and Fitch, R. M. Ed. *Future Directions in Polymer Colloids*, NATO ASI Series, No 138, Martinus Nijhoff Publishers, 1987; Arshady, R. *Colloid & Polymer Science,* 1992, No 270, pages 717–732; Odian, G. *Principles of Polymerization*, 2nd Ed. Wiley(1981); and Sorenson, W. P. and Campbell, T. W. *Preparation Method of Polymer Chemistry*, 2nd Ed, Wiley (1968)).

A preferred method of preparing ultraviolet ray absorbing polymer particles in accordance with this invention is by a limited coalescence technique where a mixture of polymerizable monomers and ultraviolet ray absorbers is added to an aqueous medium containing a particulate suspending agent to form a discontinuous (oil droplet) phase in continuous (water) phase. The mixture is subjected to shearing forces, by agitation, homogenization and the like to reduce the size of the droplets. After shearing is stopped an equilibrium is reached with respect to the size of the droplets as a result of the stabilizing action of the particulate suspending agent in coating the surface of the droplets and then polymerization is completed to form an aqueous suspension of polymer particles. This process is described in U.S. Pat. Nos. 2,932,629; 5,279,934; and 5,378,577 incorporated herein by reference.

A second preferred method of preparing ultraviolet ray absorbing polymer particles in accordance with this invention is by an emulsion polymerization process where an ultraviolet ray absorber is mixed with an ethylenically unsaturated monomer or its mixture together with a water soluble initiator and a surfactant. The polymerization process is initiated in general with free radical initiators. Free radicals of any sort may be used. Preferred initiators include persulfates (such as ammonium persulfate, potassium persulfate, etc.), peroxides (such as hydrogen), azo compounds (such as azobiscyanovaleric acid), and redox initiators (such as hydrogen peroxide-iron(II) salt, potassium persulfate-sodium hydrogen sulfate, etc.). Surfactants which can be used include, for example, a sulfate, a sulfonate, a cationic compound, an amphoteric compound, and a polymeric protective colloid. Specific examples are described in "McCUTCHEON'S Volume 1: Emulsifiers & Detergents, 1995, North American Edition". Chain transfer agents may also be used to control the properties of the polymer particles formed.

The ultraviolet ray absorbing polymer particle of the invention can also be prepared by loading an ultraviolet ray absorber into a pre-formed latex particle as described in, for example, U.S. Pat. Nos. 4,199,363, 4,304,769, 4,247,627, 4,368,258, and 5,536,628. The loading process described in U.S. Pat. No. 5,536,628 does not use organic solvents, therefore is particularly preferred, in which a polymer latex of known solids is heated with stirring to 70 to 80° C. An ultraviolet ray absorber is heated until it reaches its liquid state and is mixed with the preheated polymer latex at high shear to generate an emulsion. The emulsion is then passed through a high energy homogenizer at least once to form an ultraviolet ray absorber impregnated latex polymer dispersion. In the process, a water soluble polymeric steric stabilizer can be used to assist the loading and the stability of resultant dispersion. Such water soluble polymeric compounds include gelatin, poly(vinyl alcohol), poly(vinyl pyrrolidone), and the like.

Any suitable hydrophilic binder can be used in practice of this invention, such as naturally occurring substances such as proteins, protein derivatives, cellulose derivatives (e.g. cellulose esters), polysaccharides, casein, and the like, and synthetic water permeable colloids such as poly(vinyl lactams), acrylamide polymers, poly(vinyl alcohol) and its derivatives, hydrolyzed polyvinyl acetates, polymers of alkyl and sulfoalkyl acrylates and methacrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl sulfonic acid copolymers, vinyl imidazole copolymers, vinyl sulfide copolymers, homopolymer or copolymers containing styrene sulfonic acid, and the like. Gelatin is the most preferred hydrophilic binder.

Colloidal silver comprises silver halide grains which have a mean equivalent circular diameter of 0.5 μm or less. These type of silver grains are too slow to be useful in forming latent images; however, they find a variety of uses in preparing photographic elements as described previously.

The light-insensitive protective layer of the invention may include other addenda, for example, thickeners, matting agents, lubricants, inorganic metal oxide particles, coating aids, charge control surfactants, and the like.

In a preferred embodiment, the light-insensitive protective layer of the present invention is coated as the outermost protective layer direcly on the top of a light sensitive layer.

In another preferred embodiment, the light-insensitive protective layer of the invention is used together with another light-insensitive protective layer coated as the outermost protective layer. In all cases, it may include matte agents, lubricants, coating aids, and surfactants in the outermost protective layers.

Various photographic process surviving matting agents for use in the outermost layer of the photographic element in accordance with preferred embodiments of the present invention include, for example, inorganic particles, such as silicone dioxide, barium sulfate, desensitized silver halide, zinc particles, calcium carbonate, and the like; organic particles of cellulose esters, cellulose ethers, starches, addition-type polymers and interpolymers prepared from ethylenically unsaturated monomers such as acrylates including acrylic acid, methacrylates including methacrylic acid, acrylamides and methacrylate amides, itaconic acid and its half esters and diesters, styrenes including substituted styrenes, acrylonitriles and methcrylonitriles, vinyl acetates, vinyl ethers, vinyl and vinylidene halides and olefins. The organic matte particles can be crosslinked using crosslinking and grafting monomers such as 1,4-butyleneglycol methacrylate, trimethylolpropane triacetate, allyl methacrylate, diallyl phthalate, divinyl bezene, and the like may be used. Other polymers that may comprise matting particles include condensation polymers such as polyurethanes, polyesters, polyamides, epoxies, and the like. Matte particles useful for the present invention are described in further detail in Research Disclosure No. 308119, published December 1989, pages 1008 to 1009.

When the matte particle is polymeric in nature, it may contain reactive functional groups capable of forming covalent bonds with the binder polymer by intermolecular crosslinking or by reaction with a crosslinking agent in order to promote improved adhesion of the matte particles to the coated layers. Suitable reactive functional groups include: hydroxyl, carboxyl, carbodiimide, epoxide, aziridine, vinyl sulfone, sulfinic acid, active methylene, amino, amide, allyl, and the like. There is no particular restriction on the amount of reactive groups present, but their concentrations are preferably in the range of from 0.5 to 10 weight percent. The particle surface may be surrounded with a layer of colloidal inorganic particles as described in U.S. Pat. No. 5,288,598, or a layer of colloidal polymer latex particles which have affinity with suitable binder as described in U.S. Pat. No. 5,279,934, or a layer of gelatin as described in U.S. Pat. No. 4,855,219.

Processing removable mattes can be used together with processing surviving mattes in the practice of the preferred embodiments of the invention. Such processing removable mattes include particles of, for example, copolymers of alkyl (meth)acrylates and methacrylic acid, or acrylic acid, or itaconic acid, copolymers of alkyl (meth)acrylates and maleic monoesters or monoamides, copolymers of styrene or vinyl toluene and α,β-unsaturated mono- or di- carboxylic acids, or dicarboxylic monoesters or monoamides, Graft copolymers containing maleic anhydride or methacrylic acid, and dicarboxylic acid mono-ester of a cellulose derivative, such as phthalate and hexahydro phthalate of methyl cellulose, hydroxyethyl cellulose, or hydroxypropylomethyl cellulose. Such processing soluble mattes are described in further detail in U.S. Pat. No. 2,992,101; 3,767,448; 4,094,848; 4,447,525; and 4,524,131.

Lubricants which can be used in the light-insensitive layer of the present invention may include (1) silicone based materials disclosed, for example, in U.S. Pat. Nos. 3,489,567, 3,080,317, 3,042,522, 4,004,927, and 4,047,958, and in British Patent Nos. 955,061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc. disclosed in U.S. Pat. Nos. 2,454,043, 2,732,305, 2,976,148, 3,206,311, 3,933,516, 2,588,765, 3,121,060, 3,502,473, 3,042,222, and 4,427,964, in British Patent Nos. 1,263,722, 1,198,387, 1,430,997, 1,466,304, 1,320,757, 1,320,565, and 1,320,756, and in German Patent Nos. 1,284,295 and 1,284,294; (3) liquid paraffin and paraffin or wax like materials such as carnauba wax, natural and synthetic waxes, petroleum waxes, mineral waxes and the like; (4) perfluoro- or fluoro- or fluorochloro-containing materials,-which include poly(tetrafluoroethlyene), poly (trifluorochloroethylene), poly(vinylidene fluoride, poly (trifluorochloroethylene-co-vinyl chloride), poly(meth) acrylates or poly(meth)acrylamides containing perfluoroalkyl side groups, and the like. Lubricants useful in the present invention are described in further detail in Research Disclosure No.308119, published December 1989, page 1006.

The photographic element of the present invention can contain at least one electrically conductive layer, which can be either surface protective layer or a sub layer. The surface resistivity of at least one side of the support is preferably less than $1\times10^{11}$ Ω/square, more preferably less than $1\times10^{11}$ Ω/square at 25° C. and 20 percent relative humidity. To lower the surface resistivity, a preferred method is to incorporate at least one type of electrically conductive material in the electrically conductive layer. Such materials include both conductive metal oxides and conductive polymers or oligomeric compounds. Such materials have been described in detail in, for example, U.S. Pat. Nos. 4,203,769; 4,237,194; 4,272,616; 4,542,095; 4,582,781; 4,610,955; 4,916,011; and 5,340,676.

The present invention is also directed to a single use camera having incorporated therein a photographic element as described above. Single use cameras are known in the art under various names: film with lens, photosensitive material package unit, box camera and photographic film package. Other names are also used, but regardless of the name, each shares a number of common characteristics. Each is essentially a photographic product (camera) provided with an exposure function and preloaded with a photographic material. The photographic product comprises an inner camera shell loaded with the photographic material, a lens opening and lens, and an outer wrapping(s) of some sort. The photographic materials are exposed in camera, and then the product is sent to the developer who removes the photographic material and develop it. Return of the product to the consumer does not normally occur.

Single use camera and their methods of manufacture and use are described in U.S. Pat. Nos. 4,801,957; 4,901,097; 4,866,459; 4,849,325; 4,751,536; 4,827,298; European Patent Applications 460,400; 533,785; 537,225; all of which are incorporated herein by reference.

The photographic processing steps to which the raw film may be subject may include, but are not limited to the following:

1.) color developing→bleach-fixing→washing/stabilizing;

2.) color developing→bleaching→fixing→washing/stabilizing;

3.) color developing→bleaching→bleach-fixing→washing/stabilizing;

4.) color developing→stopping→washing→bleaching→washing→fixing→washing/stabilizing;

5.) color developing→bleach-fixing→fixing→washing/stabilizing;

6.) color developing→bleaching-→bleach-fixing→fixing→washing/stabilizing;

Among the processing steps indicated above, the steps 1), 2), 3), and 4) are preferably applied. Additionally, each of the steps indicated can be used with multistage applications as described in Hahm, U.S. Pat. No. 4,719,173, with co-current, counter-current, and contraco arrangements for replenishment and operation of the multistage processor.

Any photographic processor known to the art can be used to process the photosensitive materials described herein. For instances large volume processors, and so-called minilab and microlab processors may be used. Particularly advantageous would be the use of Low Volume Thin Tank processors as described in the following references: WO 92/10790; WO 92/17819; WO 93/04404; WO 92/17370; WO 91/19226; WO 91/12567; WO 92/07302; WO 93/00612; WO 92/07301; WO 02/09932; U.S. Pat. No. 5,294,956; EP 559,027; U.S. Pat. No. 5,179,404; EP 559,025; U.S. Pat. No. 5,270,762; EP. 559,026; U.S. Pat. No. 5,313,243; U.S. Pat. No. 5,339,131.

The present invention is also directed to photographic systems where the processed element may be re-introduced into the cassette. These system allows for compact and clean storage of the processed element until such time when it may be removed for additional prints or to interface with display equipment. Storage in the roll is preferred to facilitate location of the desired exposed frame and to minimize contact with the negative. U.S. Pat. No. 5,173,739 discloses a cassette designed to thrust the photographic element from the cassette, eliminating the need to contact the film with mechanical or manual means. Published European Patent Application 0 476 535 A1 describes how the developed film may be stored in such a cassette.

The present invention will now be described in detail with reference to examples; however, the present invention should not limited by these examples.

The ultraviolet ray absorbers used in the coating examples have the following structures:

(UV-1)

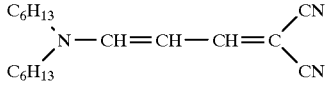

-continued (UV-2)

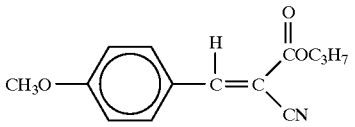

UV-D1 is prepared by first dissolving UV-1 and UV-2 at a weight ratio 1:1 in a high boiling organic solvent, and the resultant solutions are then dispersed in aqueous gelatin solutions by using a homogenizer at 5000 psi and at 80° C. The dispersions are used to form coating solutions in the comparative coating examples.

The ultraviolet ray absorbing polymer particle PUV-1 is prepared by loading UV-1 and UV-2 at a weight ratio of 0.9:1 into a poly(ethyl methacrylate-co-sodium 2-acrylamido-2-methylpropane sulfonate ) (95/5 wt %) latex prepared by emulsion polymerization. The latex has a particle size of about 95 nm. The ultraviolet ray absorbing polymer particle has a polymer to ultraviolet ray absorber ratio of 2:1 by weight.

The ultraviolet ray absorbing polymer particle PUV-2 is prepared by incorporating UV-1 and UV-2 at a weight ratio of 0.9:1 into a poly(butyl methacrylate-co-sodium 2-acrylamido-2-methylpropane sulfonate-co-acetoacetoxyethyl methacrylate) latex. The latex has a particle size of about 67 nm. The ultraviolet ray absorbing polymer particle has a polymer to ultraviolet ray absorber ratio of 2.37:1.

EXAMPLES

Examples 1 to 6

Coating Solution Quality

Coating solution quality is tested as follows:

Solutions are made at 40° C. at 7.2 wt % lime-processed gelatin, various amount of colloidal silver particles, and UV-D1, or PUV-1, or PUV-2. The coating solution is then held at 40° C. for 15 hours. The quality of the resultant solutions is evaluated by measuring the number of particles per gram of solution larger than 5 microns in size using a Coulter Counter technique. Table 1 shows the results.

TABLE 1

Coating solution quality

| solutions | collodidal silver conc. wt % | ultraviolet ray absorber | # of particles larger than 5 μm per gram solution |
|---|---|---|---|
| Example 1 (Comparison) | 0.55 | UV-D1<br>UV-1/UV-2: 2.2 wt %<br>Solvent: 1.76 wt % | $3.4 \times 10^5$ |
| Example 2 (Comparison) | 1.11 | UV-D1<br>UV-1/UV-2: 2.2 wt %<br>Solvent: 1.76 wt % | $1.1 \times 10^6$ |
| Example 3 (Comparison) | 2.22 | UV-D1<br>UV1/UV-2: 2.2 wt %<br>Solvent: 1.76 wt % | $1.9 \times 10^6$ |
| Example 4 (Comparison) | 2.77 | UV-D1<br>UV-1/UV-2: 2.2 wt %<br>Solvent: 1.76 wt % | $1.2 \times 10^7$ |
| Example 5 (Invention) | 2.22 | PUV-1<br>UV-1/UV-2: 2.1 wt %<br>Polymer: 4.2 wt % | $8.9 \times 10^3$ |

TABLE 1-continued

| | Coating solution quality | | |
|---|---|---|---|
| solutions | collodidal silver conc. wt % | ultraviolet ray absorber | # of particles larger than 5 μm per gram solution |
| Example 6 (Invention) | 2.22 | PUV-2<br>UV-1/UV-2: 2.1 wt %<br>Polymer: 4.99 wt % | $2.2 \times 10^4$ |

Table 1 demonstrates that the coating solutions prepared in accordance with the present invention have excellent stability against the formation of large oily particles.

Example 7 to 9

Photographic Elements

A series of photographic elements are prepared as follows: A poly(ethylene naphthalate) support is used having an antihalation layer on one side and an antistatic layer overcoated with a photographically transparent magnetic recording layer on the other side. The magnetic recording layer comprises a dispersion of colbalt-modified γ-iron oxide particles in a polymeric binder with a crosslinker and abrasive particles. The polymeric binder is a mixture of cellulose diacetate and cellulose triacetate. Total dry coverage for the magnetic layer is normally about 1.5 g/m$^2$. The support is coated on the antihalation layer side with the following imaging forming layer in sequence.

Interlayer

This layer comprises compound 2,5-di-t-octyl-1,4-dihydroxy benzene (0.075 g/m$^2$), tri(2-ethylhexyl)phosphate (0.113 g/m$^2$), and gelatin (0.86 g/m$^2$).

Slow Cyan Dye-forming Layer

This layer comprises a red sensitive silver bromoiodide emulsion (3.3 mole percent iodide) (0.324 μm grain size) (0.387 g/m$^2$ silver), compound CC-1 (0.355 g/m$^2$), IR-4 (0.011 g/m$^2$), B-1 (0.075 g/m$^2$), S-2 (0.377 g/m$^2$), S-3 (0.098 g/m$^2$), and gelatin (1.64 g/m$^2$).

Mid Cyan Dye-forming Layer

This layer comprises a blend of a red sensitive silver bromoiodide emulsion (3.3 mole percent iodide) (0.488 μm grain size) (0.816 g/m$^2$ silver) and a red sensitive, tabular grain, silver bromoiodide emulsion (4.5 mole percent iodide) (0.98 μm diameter by 0.11 μm thick) (0.215 g/m$^2$ silver), compound CC-1 (0.183 g/m$^2$), IR-3 (0.054 g/m$^2$), B-1 (0.027 g/m$^2$), CM-1 (0.011 g/m$^2$), S-2 (0.183 g/m$^2$), S-3 (0.035 g/m$^2$), S-5 (0.054 g/m$^2$), and gelatin (1.35 g/m$^2$).

Fast Cyan Dye-forming Layer

This layer comprises a red sensitive, tabular grain, silver bromoiodide emulsion (4.5 mole percent iodide) (1.10 μm diameter by 0.11 μm thick) (1.08 g/m$^2$ silver), compound CC-1 (0.161 g/m$^2$), IR-3 (0.038 g/m$^2$), IR-4 (0.038 g/m$^2$), CM-1 (0.032 g/m$^2$), S-2 (0.237 g/m$^2$), S-5 (0.038 g/m$^2$), and gelatin (1.35 g/m$^2$).

Interlayer

This layer comprises compound 2,5-di-t-octyl-1,4-dihydroxy benzene (0.075 g/m$^2$), tri(2-ethylhexyl)phosphate (0.113 g/m$^2$), and gelatin (0.86 g/m$^2$).

Slow Magenta Dye-forming Layer

This layer comprises a blend of a green sensitive, tabular grain, silver bromoiodide emulsion (1.5 mole percent iodide) (0.7 μm diameter by 0.112 μm thick) (0.258 g/m$^2$ Ag), and a green sensitive, tabular grain, silver bromoiodide emulsion (1.3 mole percent iodide) (0.54 μm diameter by 0.086 μm thick) (0.409 g/m$^2$ Ag), compound M-1 (0.204 g/m$^2$), MM-1 (0.038 g/m$^2$), ST-1 (0.020 g/m$^2$), S-1 (0.26 g/m$^2$), and gelatin (1.18 g/m$^2$).

Mid Magenta Dye-forming Layer

This layer comprises a green sensitive, tabular grain, silver bromoiodide emulsion (4.5 mole percent iodide) (0.61 μm diameter by 0.12 μm thick) (0.646 g/m$^2$ Ag), compound M-1 (0.099 g/m$^2$), MM-1 (0.027 g/m$^2$), IR-2 (0.022 g/m$^2$), ST-1 (0.010 g/m$^2$), S-1 (0.143 g/m$^2$), S-2 (0.044 g/m$^2$), and gelatin (1.41 g/m$^2$).

Fast Magenta Dye-forming Layer

This layer comprises a green sensitive, tabular grain, silver bromoiodide emulsion (4.5 mole percent iodide) (0.98 μm diameter by 0.113 μm thick) (0.699 g/m$^2$ Ag), compound M-1 (0.052 g/m$^2$), MM-1 (0.032 g/m$^2$), IR-2 (0.022 g/m$^2$), ST-1 (0.005 g/m$^2$), S-1 (0.111 g/m$^2$), S-2 (0.044 g/m$^2$), and gelatin (1.123 g/m$^2$).

Yellow Filter Layer

This layer comprises compound 2,5-di-t-octyl-1,4-dihydroxy benzene (0.075 g/m$^2$), YD-2 (0.108 g/m$^2$), Irganox 1076 sold by Ciba-Geigy (0.01 g/m$^2$), S-2 (0.12$^1$g/m$^2$), and gelatin.

Slow Yellow Dye-forming Layer

This layer comprises a blend of a blue sensitive, tabular grain, silver bromoiodide emulsion (4.5 mole percent iodide) (1.4 μm diameter by 0.131 μm thick) (0.161 g/m$^2$ Ag), a blue sensitive, tabular grain, silver bromoiodide emulsion (1.5 mole percent iodide) (0.85 μm diameter by 0.131 μm thick) (0.0.108 g/m$^2$ Ag), and a blue sensitive, tabular grain, silver bromoiodide emulsion (1.3 mole percent iodide) (0.54 μm diameter by 0.086 μm thick) (0.161 g/m$^2$ Ag), compound Y-1 (0.915 g/m$^2$), IR-1 (0.032 g/m$^2$), B-1 (0.0065 g/m$^2$), S-1 (0.489 g/m$^2$), S-3 (0.0084 g/m$^2$), and gelatin (1.668 g/m$^2$).

Fast Yellow Dye-forming Layer

This layer comprises a blue sensitive, tabular grain, silver bromoiodide emulsion (4.5 mole percent iodide) (2.3 μm diameter by 0.128 μm thick) (0.43 g/m$^2$ Ag), compound Y-1 (0.15 g/m$^2$), IR-1 (0.03 g/m$^2$), B-1 (0.0054 g/m$^2$), S-1 (0.091 g /m$^2$), S-3 (0.0070 g/m$^2$), and gelatin (0.753 g/m$^2$).

Second Protective Layer

Various compositions according to Table 2.

First Protective Layer

Various compositions according to Table 3.

Y1
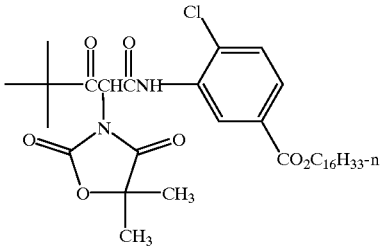
IR-1
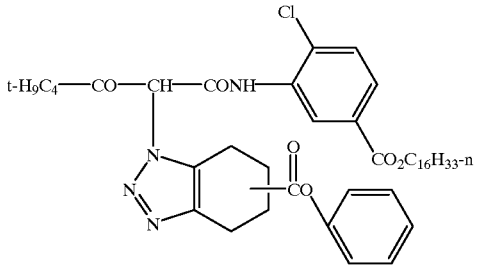
YD-2
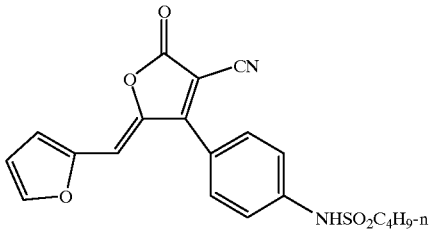
ST-1
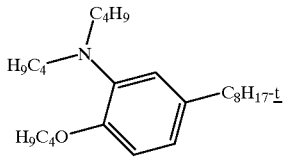
IR-2
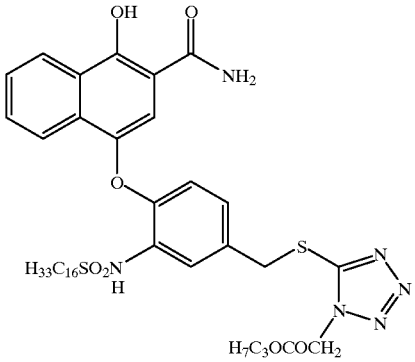
IR-3
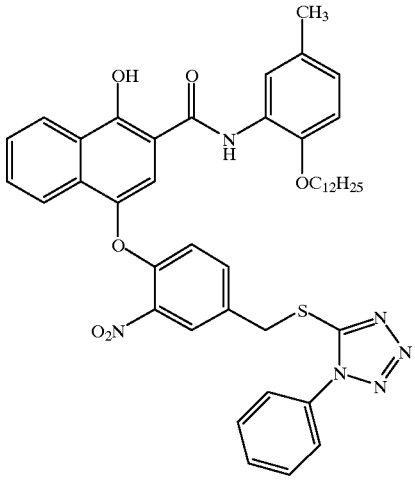
IR-4
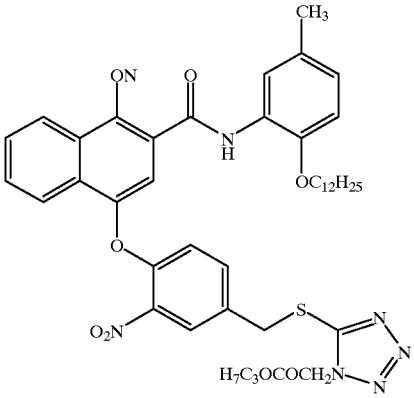
B-1
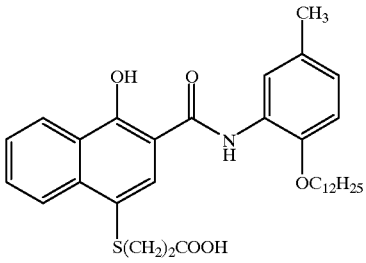

-continued
M-1
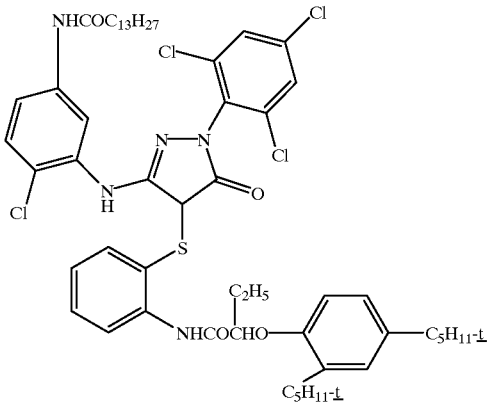
MM-1
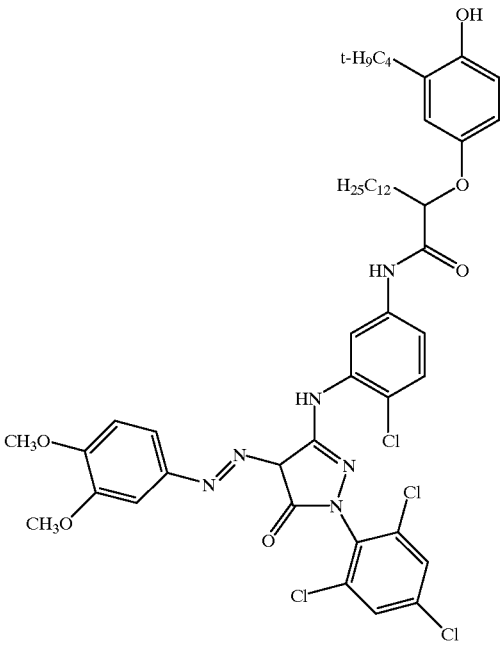
CC-1
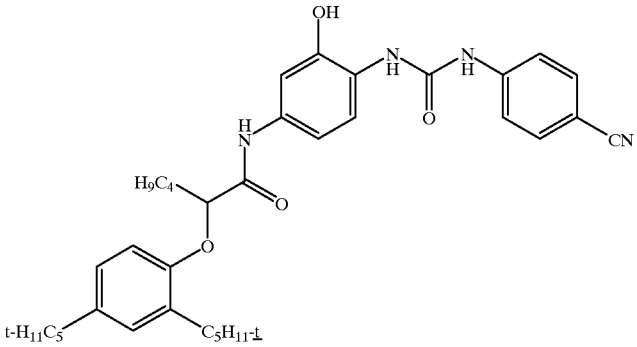
CM-1
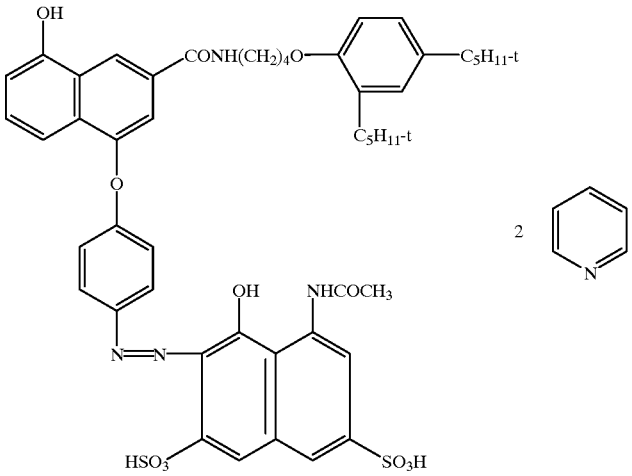
2
S-1
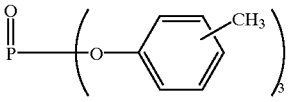
S-2
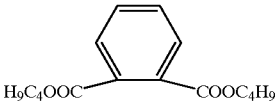

-continued

S-3

$C_{11}H_{23}CON(C_2H_5)_2$

S-4

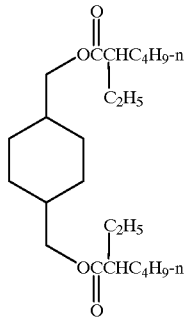

S-5

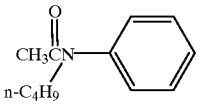

TABLE 2

| Composition of the Second Protective Layer | |
|---|---|
| Gelatin, lime processed | 0.7 g/m$^2$ |
| Colloidal silver | 0.215 g/m$^2$ |
| Ultraviolet ray absorber | Table 4 |

TABLE 3

| Composition of the First Protective Layer | |
|---|---|
| Gelatin, lime processed | 0.888 g/m$^2$ |
| Silicone lube, DC-200 (Dow Corning) | 0.0401 g/m$^2$ |
| Fluorad FC-134 (3M Co.) | 0.0039 g/m$^2$ |
| Aerosol OT (American Cyanamide) | 0.0215 g/m$^2$ |
| Surfactant Olin 10G (Olin Corp.) | 0.0272 g/m$^2$ |
| Poly(methyl methacrylate) matte, 1.5 $\mu$m | 0.0538 g/m$^2$ |
| Poly(methyl methacrylate-co-methacrylic acid) 45/55 wt % 2.7 $\mu$m | 0.107 g/m$^2$ |

Table 4 shows the compositions of first protective layers of each photographic element prepared.

TABLE 4

| | First Protective Layer | |
|---|---|---|
| Examples | Ultraviolet Ray Absorber | mg/m$^2$ |
| Example 7 (Comparison) | UV-D1 | UV-1: 108<br>UV-2: 108<br>HBS*: 173 |
| Example 8 (Invention) | PUV-1 | UV-1: 108<br>UV-2: 97.2<br>Polymer: 410 |
| Example 9 (Invention) | PUV-2 | UV-1: 108<br>UV-2: 97.2<br>Polymer: 485 |

*HBS: high boiling organic solvent

Taber scratch and abrasion resistance test

To evaluate the abrasion resistance of the protective overcoat, discs of coatings after processing are placed on a Taber Abrader and abraded in accordance with ASTM method D1044. Since the outermost layer contains matting agents, the measurement based on percentage light transmission or difference in percentage haze (Delta Haze) before and after Taber abrasion cannot be used to measure the abrasion resistance of the coatings. Instead, a Gould Microtopographer 200 is used to measured the surface roughness within the track area of the samples after Taber abrasion. The surface roughness is then analyzed in terms of two parameters: PPCM which counts the number of scratches produced by Taber wheels per centimeter and Ra which accounts for the average surface roughness. The product of the two (Ra×PPCM) is used here to quantify how badly the sample surface is scratched. The larger the Ra×PPCM value, the poorer the scratch resistance of the sample. The results are summarized in Table 5.

TABLE 5

| Example | Ra × PPCM |
|---|---|
| Example 7 (Comparative) | 4.9 |
| Example 8 (Invention) | 2.1 |
| Example 9 (Invention) | 3.8 |

Comparative Example 7 contains colloidal silver particles and ultraviolet ray absorber/HBS dispersions in the second protective layer and it shows poor scratch resistance. On the other hand, Examples 8 and 9 are prepared according to the present invention and show excellent post process scratch resistance.

The invention has been described in detail with particular reference to certain preferred embodiments thereof, but it will be understood that variations and modifications can be effected within the spirit and scope of the invention.

What is claimed is:

1. A silver halide photographic element comprising:

a support;

at least one light sensitive silver halide emulsion layer; and at least one light-insensitive protective layer comprising a hydrophilic binder, colloidal silver particles at a coating weight of form 150 to 300 mg/m$^2$ and an ultraviolet ray absorbing polymer particle having a mean size of greater than 0.01 $\mu$m, the ultraviolet ray absorbing polymer particle comprising an ultraviolet ray absorber and a polymer derived from monomer A and less than 10 weight percent of monomer B, wherein monomer A represents ethylenically unsaturated monomers which form substantially water insoluble homopolymers, and monomer B represents ethylenically unsaturated monomers capable of forming water soluble homopolymers.

2. The photographic element of claim 1 wherein monomer A is selected from the group consisting of alkyl esters of acrylic acid, alkyl esters of methacrylic acid, hydroxyalkyl esters of acrylic acid, hydroxyalkyl esters of methacrylic acid, nitriles of acrylic acid, nitriles of methacrylic acid, amides of acrylic acid, amides of methacrylic acid, vinyl acetate, vinyl propionate, vinylidene chloride, vinyl chloride, styrene, t-butyl styrene, ethyl vinyl benzene, vinyl toluene, dialkyl maleates, dialkyl itaconates, dialkyl malonates, isoprene, and butadiene.

3. The photographic element of claim 1 wherein monomer B is selected from the group consisting of (meth) acrylamides, poly(ethylene glycol)(meth)acrylates, N-vinyl-2-pyrrolidone, vinylimidazole, acrylic acid, methacrylic acid, and sodium acrylamido-2-methylpropane sulfonate.

4. The photographic element of claim 1 further wherein the polymer further comprises crosslinking monomers selected from the group consisting of allyl methacrylate, allyl acrylate, butenyl acrylate, undecenyl acrylate, undecenyl methacrylate, vinyl acrylate, vinyl methacrylate, ethylene glycol diacrylate, ethylene glycol dimethacrylate, triethylene glycol dimethacrylate, 1,4-butanediol dimethacrylate, 1,3-butanediol dimethacrylate, and divinyl benzene.

5. The photographic element of claim 1 wherein the ultraviolet ray absorber comprises a compound represented by formula I.

(I)

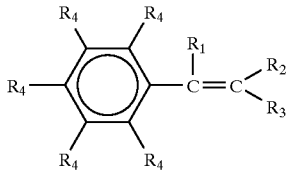

wherein $R_4$, is independently selected from the group consisting of a hydrogen, a halogen, an alkyl group, an aryl group having from 6 to 20 carbon atoms, an alkoxy group, an aryloxy, an alkylthio group, an arylthio group, an amine group, an alkylamino group, an arylamino group, an hydroxyl group, a cyano group, a nitro group, an acylamino group, a sulfonyl group, a sulfoamido group, an acyloxy group, or an oxycarbonyl group, or two neighboring $R_4$ groups may form a 5- or 6-member ring by ring closure, $R_1$ represents a hydrogen atom, or an alkyl group, $R_2$ and $R_3$ each represents a cyano group, —$COOR_9$, —CO—$NHR_9$, —$SO_2R_9$, CO—$R_9$, where $R_9$ represents an alkyl group, and an aryl group.

6. The photographic element of claim 1 wherein the ultraviolet ray absorber comprises a compound represented by formula III (III)

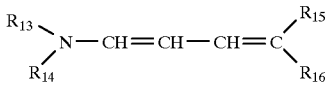

where $R_{13}$, and $R_{14}$, is each independently selected from the group consisiting of a hydrogen atom, an alkyl group, an aryl group, $R_{15}$ and $R_{16}$ each represents a cyano group, —$COOR_{17}$, $COR_{17}$, $SO_2R_{17}$, where $R_{17}$ represents an alkyl group, or an aryl group.

7. The photographic element of claim 1 wherein the ultraviolet ray absorber comprises a compound represented by formula IV:

(IV)

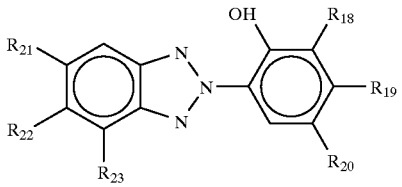

where $R_{18}$, $R_{19}$, $R_{20}$, $R_{21}$, $R_{22}$, and $R_{23}$ is each independently selected from the group consisting of a hydrogen atom, a halogen atom, a nitro group, a hydroxyl group, an alkyl group, an aryl group, an alkoxy group, an aryloxy group, an alkylthio group, an arylthio group, an aralkylthio group, an akoxycarbonyl group, a carbamoyl group, an alkylsulfonyl group, a monoalkylamino group or dialkylamino group.

8. The photographic element of claim 1 wherein said support is selected from the group consisting of cellulose nitrate film, cellulose acetate film, poly(vinyl acetal) film, polystyrene film, poly(ethylene terephthalate) film, poly (ethylene naphthalate) film and polycarbonate film.

9. The photographic element of claim 1 wherein the light insensitive protective layer has a thickness of from 0.1 to 6 $\mu$m.

10. The photographic element of claim 1 wherein the polymer has a glass transition temperature of greater than 40° C.

11. The photographic element of claim 1 further comprising at least one electrically conductive layer.

12. The photographic element of claim 1 further comprising a transparent magnetic recording layer.

13. The photographic element of claim 1 wherein the hydrophilic binder is selected from the group consisting of proteins, protein derivatives, cellulose derivatives, polysaccharides, poly(vinyl lactams), acrylamide polymers, poly(vinyl alcohol), derivatives of poly(vinyl alcohol), hydrolyzed polyvinyl acetates, alkyl polymers, and sulfoalkyl acrylates polymers, methacrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl sulfonic acid copolymers, vinyl imidazole copolymers, vinyl sulfide copolymers, homopolymer containing styrene sulfonic acid, and copolymers containing styrene sulfonic acid.

* * * * *